US007104223B2

(12) United States Patent
Bussing

(10) Patent No.: US 7,104,223 B2
(45) Date of Patent: Sep. 12, 2006

(54) DETONATIVE CLEANING APPARATUS

(75) Inventor: Thomas R. A. Bussing, Sammamish, WA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/718,855

(22) Filed: Nov. 20, 2003

(65) Prior Publication Data

US 2005/0109231 A1 May 26, 2005

(51) Int. Cl.
*F22B 37/48* (2006.01)

(52) U.S. Cl. ..... 122/379

(58) Field of Classification Search ..... 102/302, 102/312, 313, 379, 390, 395, 396; 122/405
See application file for complete search history.

(56) References Cited

U.S. PATENT DOCUMENTS

| | | | | |
|---|---|---|---|---|
| 2,714,563 | A * | 8/1955 | Poorman et al. | 427/446 |
| 5,082,502 | A | 1/1992 | Lee et al. | |
| 5,430,691 | A | 7/1995 | Fridman | |
| 5,494,004 | A | 2/1996 | Hunter, Jr. | |
| 6,438,191 | B1 | 8/2002 | Bickes, Jr. et al. | |
| 6,684,823 | B1 * | 2/2004 | Plavnik et al. | 122/379 |
| 6,755,156 | B1 * | 6/2004 | Zilka et al. | 122/379 |
| 6,935,281 | B1 * | 8/2005 | Ruegg | 122/379 |
| 2001/0007247 | A1 * | 7/2001 | Zilka et al. | 122/379 |
| 2002/0112638 | A1 | 8/2002 | Zilka et al. | |
| 2003/0196600 | A1 * | 10/2003 | Eidelman | 118/715 |
| 2004/0112306 | A1 | 6/2004 | Ruegg | |

FOREIGN PATENT DOCUMENTS

| | | |
|---|---|---|
| WO | WO01/78912 A1 | 10/2001 |
| YU | P 1756/88 | 6/1990 |
| YU | P 1728/88 | 2/1992 |

OTHER PUBLICATIONS

Hanjalic et al., "Detonation-Wave Technique for On-Load Deposit . . . ", Journal of Engineering for Gas Turbines and Power, Jan. 1994, pp. 223-236, vol. 116.
Huque, "Experimental Investigation of Slag Removal Using . . . ", Annual Symposium, Mar. 16-18, 1999, pp. 1-6, Miami, FL.
Hanjalic et al., "Further Experience in Using Detonation Waves . . . ", International Journal of Energy Research, Apr. 7, 1993, pp. 583-595, vol. 17.

* cited by examiner

*Primary Examiner*—Troy Chambers
(74) *Attorney, Agent, or Firm*—Bachman & LaPointe, P.C.

(57) ABSTRACT

An apparatus and methods are provided for cleaning a surface within a vessel. A vessel wall separates a vessel exterior from a vessel interior and has a wall aperture. An elongate conduit has an upstream first and a downstream second end and is positioned to direct a shock wave from the second end into the vessel interior. A source of fuel and oxidizer is coupled to the conduit to deliver the fuel an oxidizer to the conduit. An initiator is positioned to initiate a reaction of the fuel and oxidizer to produce the shock wave within the conduit for generating the shock wave. A source of purge gas is positioned to introduce the purge gas to the conduit to drive reaction products of the fuel and oxidizer downstream.

19 Claims, 4 Drawing Sheets

DETONATIVE CLEANING APPARATUS

BACKGROUND OF THE INVENTION (1) Field of the Invention

The invention relates to industrial equipment. More particularly, the invention relates to the detonative cleaning of industrial equipment.

(2) Description of the Related Art

Surface fouling is a major problem in industrial equipment. Such equipment includes furnaces (coal, oil, waste, etc.), boilers, gasifiers, reactors, heat exchangers, and the like. Typically the equipment involves a vessel containing internal heat transfer surfaces that are subjected to fouling by accumulating particulate such as soot, ash, minerals and other products and byproducts of combustion, more integrated buildup such as slag and/or fouling, and the like. Such particulate build-up may progressively interfere with plant operation, reducing efficiency and throughput and potentially causing damage. Cleaning of the equipment is therefore highly desirable and is attended by a number of relevant considerations. Often direct access to the fouled surfaces is difficult. Additionally, to maintain revenue it is desirable to minimize industrial equipment downtime and related costs associated with cleaning. A variety of technologies have been proposed. By way of example, various technologies have been proposed in U.S. Pat. Nos. 5,494,004 and 6,438,191 and U.S. patent application publication 2002/0112638. Additional technology is disclosed in Huque, Z. Experimental Investigation of Slag Removal Using Pulse Detonation Wave Technique, DOE/HBCU/OMI Annual Symposium, Miami, Fla., Mar. 16–18, 1999. Particular blast wave techniques are described by Hanjalić and Smajević in their publications: Hanjalić, K. and Smajević, I., Further Experience Using Detonation Waves for Cleaning Boiler Heating Surfaces, International Journal of Energy Research Vol. 17, 583–595 (1993) and Hanjalić, K. and Smajević, I., Detonation-Wave Technique for On-load Deposit Removal from Surfaces Exposed to Fouling: Parts I and II, Journal of Engineering for Gas Turbines and Power, Transactions of the ASME, Vol. 1, 116 223–236, January 1994. Such systems are also discussed in Yugoslav patent publications P 1756/88 and P 1728/88. Such systems are often identified as "soot blowers" after an exemplary application for the technology.

Nevertheless, there remain opportunities for further improvement in the field.

SUMMARY OF THE INVENTION

One aspect of the invention involves an apparatus for cleaning a surface within a vessel. A vessel wall separates a vessel exterior from a vessel interior and has a wall aperture. An elongate conduit has an upstream first and a downstream second end and is positioned to direct a shock wave from the second end into the vessel interior. A source of fuel and oxidizer is coupled to the conduit to deliver the fuel and oxidizer to the conduit. An initiator is positioned to initiate a reaction of the fuel and oxidizer to produce a detonation wave within the conduit for generating the shock wave. A source of purge gas is coupled to the conduit to introduce the purge gas to the conduit to drive reaction products of the fuel and oxidizer downstream.

In various implantations, the conduit may have a first portion and a second portion downstream thereof. The first portion may have a first characteristic cross-sectional area and the second portion may have a second characteristic cross-sectional area which may also be greater than the first. The initiator may be positioned to initiate a deflagration of the fuel and oxidizer in the first portion so that a deflagration-to-detonation transition from such deflagration produces the detonation wave. The source of fuel and oxidizer may include first fuel and oxidizer sources of first fuel and oxidizer and second fuel and oxidizer sources of second fuel and oxidizer. The second fuel and oxidizer sources may be coupled to the conduit downstream of where the first fuel and oxidizer sources are coupled.

Another aspect of the invention involves a method for cleaning a surface within a vessel. The vessel has a wall with an aperture therein. Fuel and oxidizer are introduced to a conduit. A reaction of the fuel and oxidizer is initiated so as to cause a shock wave to impinge upon the surface. A pressurized purge gas is then introduced to the conduit.

In various implantations, the method may be formed in a repeated sequential way. The reaction may comprise a deflagration-to-detonation transition. The purge gas may comprise, in major portion, air. The purge gas may be introduced through a purge gas port in an upstreammost 20% of a flowpath length within the conduit. The introduction of fuel and oxidizer may include introducing a first fuel and oxidizer forming a first fuel/oxidizer mixture and introducing a second fuel and oxidizer forming a second fuel/oxidizer mixture, the second mixture being less detonable than the first mixture. The second oxidizer may be less oxygen-rich than the first oxidizer. The second fuel/oxidizer mixture may be introduced as a mixture. The second fuel/oxidizer mixture may provide a slower reaction chemistry than a reaction chemistry of the first fuel/oxidizer mixture. A major portion of the first fuel/oxidizer mixture may be provided before or after a major portion of the second fuel/oxidizer mixture is provided.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
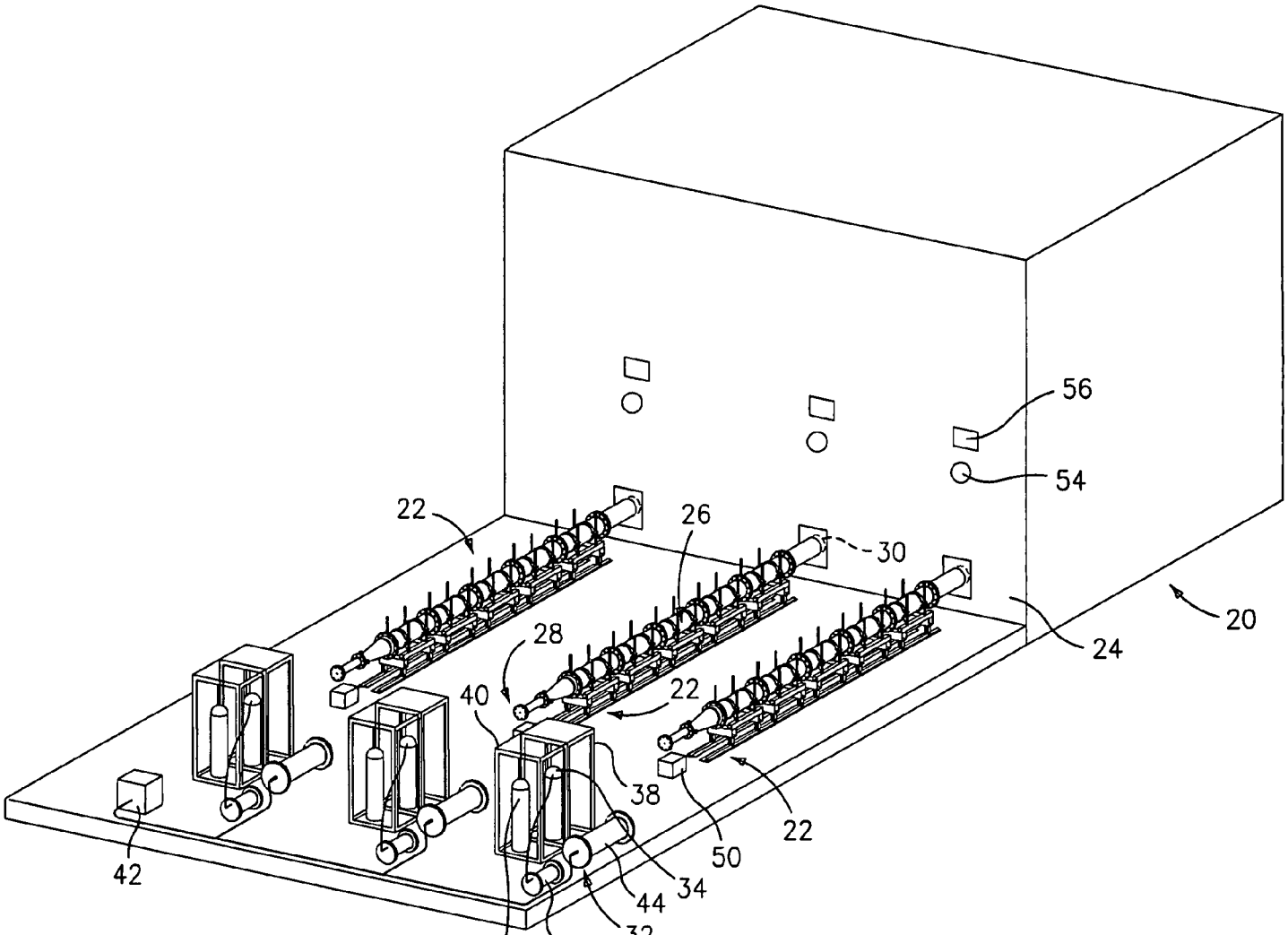
FIG. 1 is a view of an industrial furnace associated with several soot blowers positioned to clean a level of the furnace.

FIG. 1 shows a furnace 20 having an exemplary three associated soot blowers 22. In the illustrated embodiment, the furnace vessel is formed as a right parallelepiped and the soot blowers are all associated with a single common wall 24 of the vessel and are positioned at like height along the wall. Other configurations are possible (e.g., a single soot blower, one or more soot blowers on each of multiple levels, and the like).

Each soot blower 22 includes an elongate combustion conduit 26 extending from an upstream distal end 28 away from the furnace wall 24 to a downstream proximal end 30 closely associated with the wall 24. Optionally, however, the end 30 may be well within the furnace. In operation of each soot blower, combustion of a fuel/oxidizer mixture within the conduit 26 is initiated proximate the upstream end (e.g., within an upstreammost 10% of a conduit length) to produce a detonation wave which is expelled from the downstream end as a shock wave along with associated combustion gases for cleaning surfaces within the interior volume of the furnace. Each soot blower may be associated with a fuel/oxidizer source 32. Such source or one or more components thereof may be shared amongst the various soot blowers. An exemplary source includes a liquified or compressed gaseous fuel cylinder 34 and an oxygen cylinder 36 in respective containment structures 38 and 40. In the exemplary embodiment, the oxidizer is a first oxidizer such as essentially pure oxygen. A second oxidizer may be in the form of shop air delivered from a central air source 42. In the exemplary embodiment, air is stored in an air accumulator 44. Fuel, expanded from that in the cylinder 34 is generally stored in a fuel accumulator 46. Each exemplary source 32 is coupled to the associated conduit 26 by appropriate plumbing below. Similarly, each soot blower includes a spark box 50 for initiating combustion of the fuel oxidizer mixture and which, along with the source 32, is controlled by a control and monitoring system (not shown). FIG. 1 further shows the wall 24 as including a number of ports for inspection and/or measurement. Exemplary ports include an optical monitoring port 54 and a temperature monitoring port 56 associated with each soot blower 22 for respectively receiving an infrared and/or visible light video camera and thermocouple probe for viewing the surfaces to be cleaned and monitoring internal temperatures. Other probes/monitoring/sampling may be utilized, including pressure monitoring, composition sampling, and the like.

Figure 2:
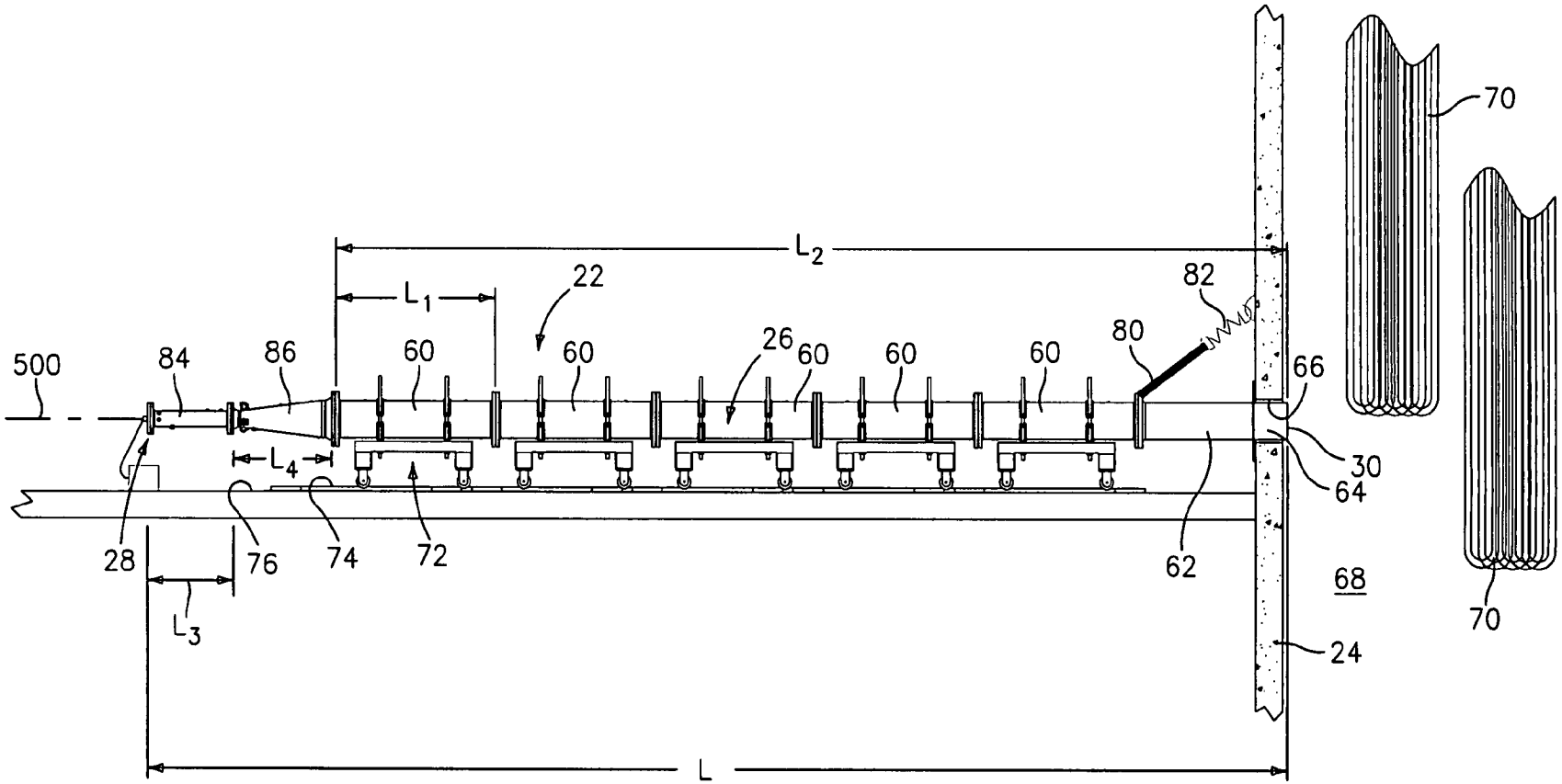
FIG. 2 is a side view of one of the blowers of FIG. 1.

FIG. 2 shows further details of an exemplary soot blower 22. The exemplary detonation conduit 26 is formed with a main body portion formed by a series of doubly flanged conduit sections or segments 60 arrayed from upstream to downstream and a downstream nozzle conduit section or segment 62 having a downstream portion 64 extending through an aperture 66 in the wall and ending in the downstream end or outlet 30 exposed to the furnace interior 68. The term nozzle is used broadly and does not require the presence of any aerodynamic contraction, expansion, or combination thereof. Exemplary conduit segment material is metallic (e.g., stainless steel). The outlet 30 may be located further within the furnace if appropriate support and cooling are provided. FIG. 2 further shows furnace interior tube bundles 70, the exterior surfaces of which are subject to fouling. In the exemplary embodiment, each of the conduit segments 60 is supported on an associated trolley 72, the wheels of which engage a track system 74 along the facility floor 76. The exemplary track system includes a pair of parallel rails engaging concave peripheral surfaces of the trolley wheels. The exemplary segments 60 are of similar length $L_1$ and are bolted end-to-end by associated arrays of bolts in the bolt holes of their respective flanges. Similarly, the downstream flange of the downstreammost of the segments 60 is bolted to the upstream flange of the nozzle 62. In the exemplary embodiment, a reaction strap 80 (e.g., cotton or thermally/structurally robust synthetic) in series with one or more metal coil reaction springs 82 is coupled to this last mated flange pair and connects the combustion conduit to an environmental structure such as the furnace wall for resiliently absorbing reaction forces associated with discharging of the soot blower and ensuring correct placement of the combustion conduit for subsequent firings. Optionally, additional damping (not shown) may be provided. The reaction strap/spring combination may be formed as a single length or a loop. In the exemplary embodiment, this combined downstream section has an overall length $L_2$.

Extending downstream from the upstream end 28 is a predetonator conduit section/segment 84 which also may be doubly flanged and has a length $L_3$. The predetonator conduit segment 84 has a characteristic internal cross-sectional area (transverse to an axis/centerline 500 of the conduit) which is smaller than a characteristic internal cross-sectional area (e.g., mean, median, mode, or the like) of the downstream portion (60, 62) of the combustion conduit. In an exemplary embodiment involving circular sectioned conduit segments, the predetonator cross-sectional area is a characterized by a diameter of between 8 cm and 12 cm whereas the downstream portion is characterized by a diameter of between 20 cm and 40 cm. Accordingly, exemplary cross-sectional area ratios of the downstream portion to the predetonator segment are between 1:1 and 10:1, more narrowly, 2:1 and 10:1. An overall length L between ends 28 and 30 may be 1–15 m, more narrowly, 5–15 m. In the exemplary embodiment, a transition conduit segment 86 extends between the predetonator segment 84 and the upstreammost segment 60. The segment 86 has upstream and downstream flanges sized to mate with the respective flanges of the segments 84 and 60 has an interior surface which provides a smooth transition between the internal cross-sections thereof. The exemplary segment 86 has a length $L_4$. An exemplary half angle of divergence of the interior surface of segment 86 is $\leqq 12°$, more narrowly 5–10°.

Figure 3:
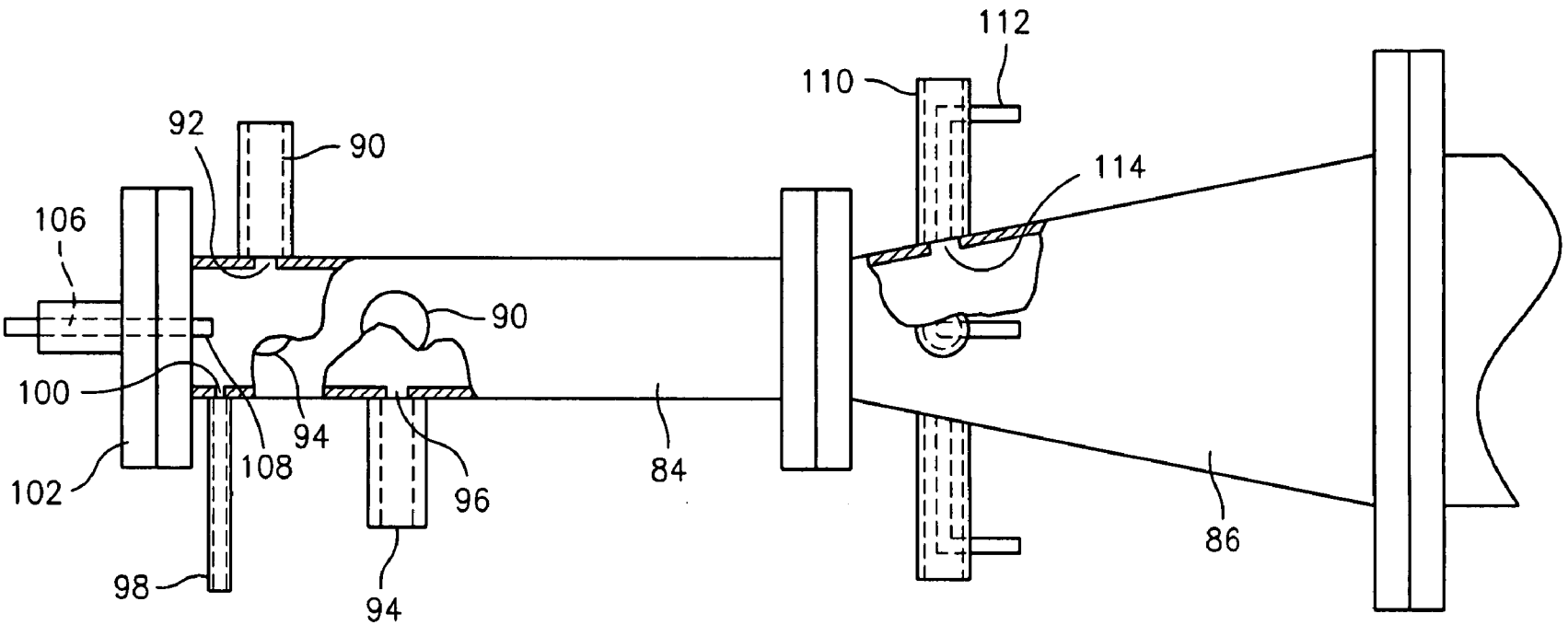
FIG. 3 is a partially cut-away side view of an upstream end of the blower of FIG. 2.

A fuel/oxidizer charge may be introduced to the detonation conduit interior in a variety of ways. There may be one or more distinct fuel/oxidizer mixtures. Such mixture(s) may be premixed external to the detonation conduit, or may be mixed at or subsequent to introduction to the conduit. FIG. 3 shows the segments 84 and 86 configured for distinct introduction of two distinct fuel/oxidizer combinations: a predetonator combination; and a main combination. In the exemplary embodiment, in an upstream portion of the segment 84, a pair of predetonator fuel injection conduits 90 are coupled to ports 92 in the segment wall which define fuel injection ports. Similarly, a pair of predetonator oxidizer conduits 94 are coupled to oxidizer inlet ports 96. In the exemplary embodiment, these ports are in the upstream half of the length of the segment 84. In the exemplary embodiment, each of the fuel injection ports 92 is paired with an associated one of the oxidizer ports 96 at even axial position and at an angle (exemplary 90° shown, although other angles including 180° are possible) to provide opposed jet mixing of fuel and oxidizer. Discussed further below, a purge gas conduit 98 is similarly connected to a purge gas port 100 yet further upstream. An end plate 102 bolted to the upstream flange of the segment 84 seals the upstream end of the combustion conduit and passes through an igniter/initiator 106 (e.g., a spark plug) having an operative end 108 in the interior of the segment 84.

In the exemplary embodiment, the main fuel and oxidizer are introduced to the segment 86. In the illustrated embodiment, main fuel is carried by a number of main fuel conduits 112 and main oxidizer is carried by a number of main oxidizer conduits 110, each of which has terminal portions concentrically surrounding an associated one of the fuel conduits 112 so as to mix the main fuel and oxidizer at an associated inlet 114. In exemplary embodiments, the fuels are hydrocarbons. In particular exemplary embodiments, both fuels are the same, drawn from a single fuel source but mixed with distinct oxidizers: essentially pure oxygen for the predetonator mixture; and air for the main mixture. Exemplary fuels useful in such a situation are propane, MAPP gas, or mixtures thereof. Other fuels are possible, including ethylene and liquid fuels (e.g., diesel, kerosene, and jet aviation fuels). The oxidizers can include mixtures such as air/oxygen mixtures of appropriate ratios to achieve desired main and/or predetonator charge chemistries. Further, monopropellant fuels having molecularly combined fuel and oxidizer components may be options.

In operation, at the beginning of a use cycle, the combustion conduit is initially empty except for the presence of air (or other purge gas). The predetonator fuel and oxidizer are then introduced through the associated ports filling the segment 84 and extending partially into the segment 86 (e.g., to near the midpoint) and advantageously just beyond the main fuel/oxidizer ports. The predetonator fuel and oxidizer flows are then shut off. An exemplary volume filled the predetonator fuel and oxidizer is 1–40%, more narrowly 1–20%, of the combustion conduit volume. The main fuel and oxidizer are then introduced, to substantially fill some fraction (e.g., 20–100%) of the remaining volume of the combustor conduit. The main fuel and oxidizer flows are then shut off. The prior introduction of predetonator fuel and oxidizer past the main fuel/oxidizer ports largely eliminates the risk of the formation of an air or other non-combustible slug between the predetonator and main charges. Such a slug could prevent migration of the combustion front between the two charges.

With the charges introduced, the spark box is triggered to provide a spark discharge of the initiator igniting the predetonator charge. The predetonator charge being selected for very fast combustion chemistry, the initial deflagration quickly transitions to a detonation within the segment 84 and producing a detonation wave. Once such a detonation wave occurs, it is effective to pass through the main charge which might, otherwise, have sufficiently slow chemistry to not detonate within the conduit of its own accord. The wave passes longitudinally downstream and emerges from the downstream end 30 as a shock wave within the furnace interior, impinging upon the surfaces to be cleaned and thermally and mechanically shocking to typically at least loosen the contamination. The wave will be followed by the expulsion of pressurized combustion products from the detonation conduit, the expelled products emerging as a jet from the downstream end 30 and further completing the cleaning process (e.g., removing the loosened material). After or overlapping such venting of combustion products, a purge gas (e.g., air from the same source providing the main oxidizer and/or nitrogen) is introduced through the purge port 100 to drive the final combustion products out and leave the detonation conduit filled with purge gas ready to repeat the cycle (either immediately or at a subsequent regular interval or at a subsequent irregular interval (which may be manually or automatically determined by the control and monitoring system)). Optionally, a baseline flow of the purge gas may be maintained between charge/discharge cycles so as to prevent gas and particulate from the furnace interior from infiltrating upstream and to assist in cooling of the detonation conduit.

Figure 4:
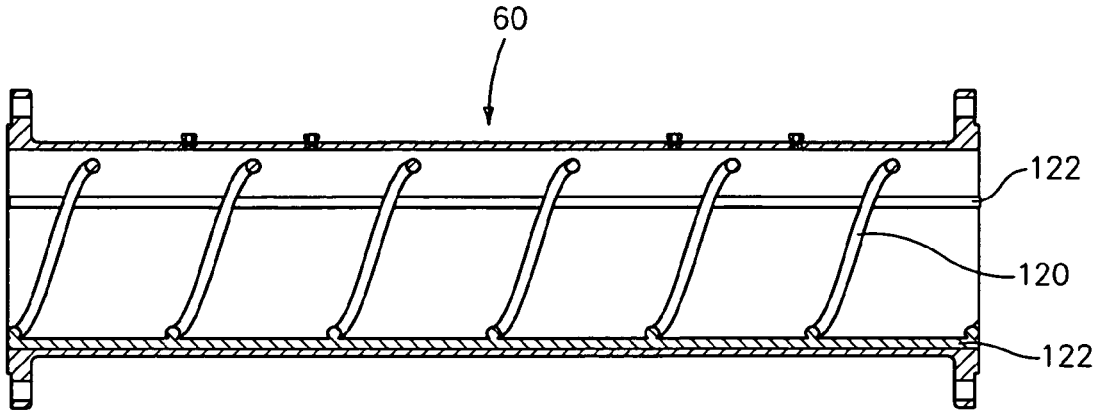
FIG. 4 is a longitudinal sectional view of a main combustor segment of the soot blower of FIG. 2.
Figure 5:
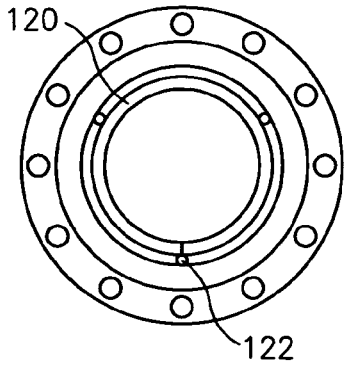
FIG. 5 is an end view of the segment of FIG. 4.

In various implementations, internal surface enhancements may substantially increase internal surface area beyond that provided by the nominally cylindrical and frustoconical segment interior surfaces. The enhancement may be effective to assist in the deflagration-to-detonation transition or in the maintenance of the detonation wave. FIG. 4 shows internal surface enhancements applied to the interior of one of the main segments 60. The exemplary enhancement is nominally a Chin spiral, although other enhancements such as Shchelkin spirals and Smirnov cavities may be utilized. The spiral is formed by a helical member 120. The exemplary member 120 is formed as a circular-sectioned metallic element (e.g., stainless steel wire) of approximately 8–20 mm in sectional diameter. Other sections may alternatively be used. The exemplary member 120 is held spaced-apart from the segment interior surface by a plurality of longitudinal elements 122. The exemplary longitudinal elements are rods of similar section and material to the member 120 and welded thereto and to the interior surface of the associated segment 60. Such enhancements may also be utilized to provide predetonation in lieu of or in addition to the foregoing techniques involving different charges and different combustor cross-sections.

The apparatus may be used in a wide variety of applications. By way of example, just within a typical coal-fired furnace, the apparatus may be applied to: the pendents or secondary superheaters, the convective pass (primary superheaters and the economizer bundles); air preheaters; selective catalyst removers (SCR) scrubbers; the baghouse or electrostatic precipitator; economizer hoppers; ash or other heat/accumulations whether on heat transfer surfaces or elsewhere, and the like. Similar possibilities exist within other applications including oil-fired furnaces, black liquor recovery boilers, biomass boilers, waste reclamation burners (trash burners), and the like.

One or more embodiments of the present invention have been described. Nevertheless, it will be understood that various modifications may be made without departing from the spirit and scope of the invention. For example, the invention may be adapted for use with a variety of industrial equipment and with variety of soot blower technologies. Aspects of the existing equipment and technologies may influence aspects of any particular implementation. Other shapes of combustion conduit (e.g., non-straight sections to navigate external or internal obstacles) may be possible. Accordingly, other embodiments are within the scope of the following claims.

What is claimed is:

1. A method for cleaning a surface within a vessel, the vessel having a wall with an aperture therein, the method comprising:

introducing fuel and oxidizer to a conduit, the introducing comprising:

introducing a first fuel and a first oxidizer forming a first fuel/oxidizer mixture; and introducing a second fuel and a second oxidizer forming a second fuel/oxidizer mixture, the second mixture being less detonable than the first fuel/oxidizer mixture; initiating a reaction of the fuel and oxidizer so as to cause a shock wave to impinge upon the surface; and introducing a pressurized purge gas to the conduit.

2. The method of claim 1 performed in a repeated sequential way.

3. The method of claim 1 wherein:

the reaction comprises a deflagration-to-detonation transition.

4. The method of claim 1 wherein:

the purge gas comprises in major portion air.

5. The method of claim 1 wherein:

the purge gas is introduced through a purge gas port in an upstreammost 20% of a flowpath length within the conduit.

6. The method of claim 1 wherein:

the second oxidizer is less oxygen-rich than the first oxidizer; and the second fuel/oxidizer mixture is introduced as a mixture.

7. The method of claim 1 wherein:

the second fuel/oxidizer mixture provides a slower reaction chemistry than a reaction chemistry of the first fuel/oxidizer mixture.

8. The method of claim 1 wherein:

a major portion of said first fuel/oxidizer mixture is provided before a major portion of said second fuel/oxidizer mixture is provided.

9. The method of claim 1 wherein:

a major portion of said first fuel/oxidizer mixture is provided after a major portion of said second fuel/oxidizer mixture is provided.

10. The method of claim 1 wherein:

the vessel is a coal- or oil-fired furnace.

11. The method of claim 1 wherein:

the surface is of a tube bundle.

12. The method of claim 1 wherein:

a baseline flow of the purge gas is maintained between charge/discharge cycles of the conduit so as to prevent gas and particulate from the vessel from infiltrating upstream and to assist in cooling of the conduit.

13. A method for cleaning a surface within a vessel, the vessel having a wall with an aperture therein, the method comprising:

introducing fuel and oxidizer to a conduit, the introducing comprising:

introducing a first fuel and a first oxidizer forming a first fuel/oxidizer mixture; and introducing a second fuel and a second oxidizer forming a second fuel/oxidizer mixture, the second mixture being less detonable than the first mixture; and initiating a reaction of the fuel and oxidizer so as to cause a shock wave to impinge upon the surface.

14. The method of claim 13 wherein:

said introducing the first fuel and the first oxidizer is through one or more associated first ports;

said introducing the second fuel and the second oxidizer is through one or more associated second ports; and said introducing the first fuel and the first oxidizer fills a volume of the conduit extending beyond the second ports.

15. The method of claim 13 wherein:

said volume is 1–20% of a total volume of the conduit.

16. The method of claim 13 wherein:

said introducing the first fuel and the first oxidizer is through one or more associated first ports; and said introducing the second fuel and the second oxidizer is through one or more associated second ports, downstream of the first ports.

17. A method for cleaning a surface within a vessel, the vessel having a wall with an aperture therein, the method comprising:

introducing fuel and oxidizer to a conduit, the conduit having an upstream end and a downstream end, the introducing forming:

a first mixture of a first fuel and a first oxidizer; and a second mixture of a second fuel and a second oxidizer, the second mixture being downstream of the first mixture and less detonable than the first mixture; and initiating a reaction of the fuel and oxidizer so as to cause a shock wave to impinge upon the surface.

18. The method of claim 17 wherein:

the second oxidizer is less oxygen-rich than the first oxidizer; and the first fuel and second fuel are the same.

19. The method of claim 17 wherein:

the fuel and oxidizer fill 100% of the conduit.

* * * * *